US007806193B2

(12) United States Patent
Berzin et al.

(10) Patent No.: US 7,806,193 B2
(45) Date of Patent: Oct. 5, 2010

(54) SWELLABLE PACKER WITH BACK-UP SYSTEMS

(75) Inventors: Vel Berzin, Houston, TX (US); Douglas J. Murray, Magnolia, TX (US); Edward T. Wood, Kingwood, TX (US); Steven N. Bailey, Corpus Christi, TX (US); Robert O. Castillo, Stafford, TX (US); Darwin D. Arline, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 54 days.

(21) Appl. No.: 12/134,419

(22) Filed: Jun. 6, 2008

(65) Prior Publication Data

US 2009/0139707 A1 Jun. 4, 2009

Related U.S. Application Data

(60) Provisional application No. 60/933,468, filed on Jun. 6, 2007.

(51) Int. Cl.
*E21B 33/00* (2006.01)
*E21B 33/12* (2006.01)

(52) U.S. Cl. ..... 166/387; 166/132; 166/179

(58) Field of Classification Search ..... 166/387, 166/132, 191, 179; 277/331, 333, 334, 341, 277/934

See application file for complete search history.

(56) References Cited

U.S. PATENT DOCUMENTS

| | | | | |
|---|---|---|---|---|
| 3,490,525 | A | 1/1970 | Nettles | 166/97 |
| 4,590,227 | A | 5/1986 | Nakamura et al. | 523/130 |
| 5,078,211 | A | 1/1992 | Swineford | 166/202 |
| 5,092,400 | A | 3/1992 | Jagert | 166/88 |
| 5,384,370 | A | 1/1995 | Vondracek et al. | 525/209 |
| 6,581,682 | B1 | 6/2003 | Parent et al. | 166/180 |
| 7,059,415 | B2 * | 6/2006 | Bosma et al. | 166/313 |
| 7,124,831 | B2 | 10/2006 | Turley et al. | 166/387 |
| 7,431,098 | B2 * | 10/2008 | Ohmer et al. | 166/387 |
| 2004/0020662 | A1 * | 2/2004 | Freyer | 166/387 |
| 2006/0189703 | A1 * | 8/2006 | Noordegraaf | 521/56 |
| 2007/0221387 | A1 * | 9/2007 | Levy | 166/387 |
| 2008/0135260 | A1 * | 6/2008 | Berzin et al. | 166/380 |
| 2008/0185158 | A1 * | 8/2008 | Chalker et al. | 166/387 |
| 2009/0130938 | A1 * | 5/2009 | Xu et al. | 442/327 |

OTHER PUBLICATIONS

Herold et al., "Evaluating Expandable Tubular Zonal and Swelling Elastomer Isolation Using Wireline Ultrasonic Measurements," IADC/SPE 103893, Nov. 2006, 11 pages.

Kleverlaan et al., "Deployment of Swelling Elastomer Packers in Shell E&P," SPE/IADC 92346, Feb. 2005, 5 pages.

* cited by examiner

*Primary Examiner*—Daniel P Stephenson
*Assistant Examiner*—Michael Wills, III
(74) *Attorney, Agent, or Firm*—Shawn Hunter

(57) ABSTRACT

A packer assembly which incorporates a swellable elastomeric packer element and one or more swellable thermoplastic components. The swellable thermoplastic components are support rings that are located at each axial end of the elastomeric element and provide positive mechanical backups for the elastomeric element to limit extrusion of the packer element.

15 Claims, 3 Drawing Sheets

SWELLABLE PACKER WITH BACK-UP SYSTEMS

CROSS-REFERENCE TO RELATED APPLICATIONS

This application claims priority to U.S. Provisional Patent Application Ser. No. 60/933,468 filed Jun. 6, 2007.

BACKGROUND OF THE INVENTION

1. Field of the Invention

The invention relates to devices and methods for securing packer elements to a packer mandrel In particular aspects, the invention relates to the use of swellable support rings as a back-up system to prevent or limit extrusion of a swellable packer element after setting.

2. Description of the Related Art

Packers are devices that are used to create a fluid seal within a wellbore. A packer typically includes a central mandrel and an expandable packer element that is carried by the packer mandrel.

U.S. Pat. No. 3,490,525 issued to Nettles describes a blowout preventer packer unit having an elastomeric element that is molded at its ends to a pair of spaced rigid disks. During unitary molded construction of the packer unit, lips of the elastomeric sleeve are molded over a portion of the disk faces in order to strengthen the bond. Fluid elastomeric material is injected during the molding process.

U.S. Pat. No. 5,092,400 issued to Jagert describes a coiled tubing hanger device wherein a flexible packing element is bonded to upper and lower shoes by means of a mold injection bonding process.

U.S. Pat. No. 6,581,682 issued to Parent et al. describes an expandable borehole packer which incorporates granules of expandable bentonite as well as a method of pre-making the packer for later incorporation onto a pipe. Binding clamp rings are used to secure a pair of sleeves encapsulating the bentonite granules onto a pipe.

U.S. Pat. No. 5,078,211 issued to Swineford describes a plastic packer used for water wells that is typically molded out of polyurethane.

U.S. Pat. No. 7,124,831 issued to Turley et al. describes a non-metallic sealing element for use in bridge plugs, frac plugs and packers. The packer element may be made up of a polymeric composite material that is wound onto a tool mandrel and then cured in place.

SUMMARY OF THE INVENTION

The invention provides an improved packer assembly which incorporates a swellable elastomeric packer sealing element and one or more swellable thermoplastic components. In a preferred embodiment, the swellable thermoplastic components are support rings that are located at each axial end of the elastomeric element and will preferably swell more rapidly than the elastomeric element in response to contact with wellbore fluids, thereby providing positive mechanical backups for the elastomeric element.

In some embodiments, the invention provides an apparatus and a method of securing a packer element onto a packer mandrel using injection molding. During construction of the packer device, the packer element is installed over a packer mandrel. Then, a pair of injection molds is installed onto the mandrel at each axial end of the packer element. The molds allow for injection of a thermoplastic material that will fixedly secure the packer element to the mandrel and form the swellable thermoplastic components.

In a further embodiment, the swellable thermoplastic components of the present invention are formed using a compressible thermoplastic foam. The thermoplastic foam is releasably compressed and then secured to the central packer mandrel. In one preferred method of releasably compressing the foam, the compressible foam is soaked in adhesive and physically compressed to form the annular support rings. The adhesive is permitted to cure, and the foam remains compressed. Thereafter, the compressed foam rings are secured to the central packer mandrel. When the packer device is placed into a wellbore, fluids within the wellbore will break down the adhesive, thereby permitting the foam to expand radially outwardly.

BRIEF DESCRIPTION OF THE DRAWINGS

The structure and operation of the invention will be more readily understood with reference to the following drawings, which are illustrative thereof and among which like components are numbered with like reference numerals.

DETAILED DESCRIPTION OF THE PREFERRED EMBODIMENTS

Figure 1:
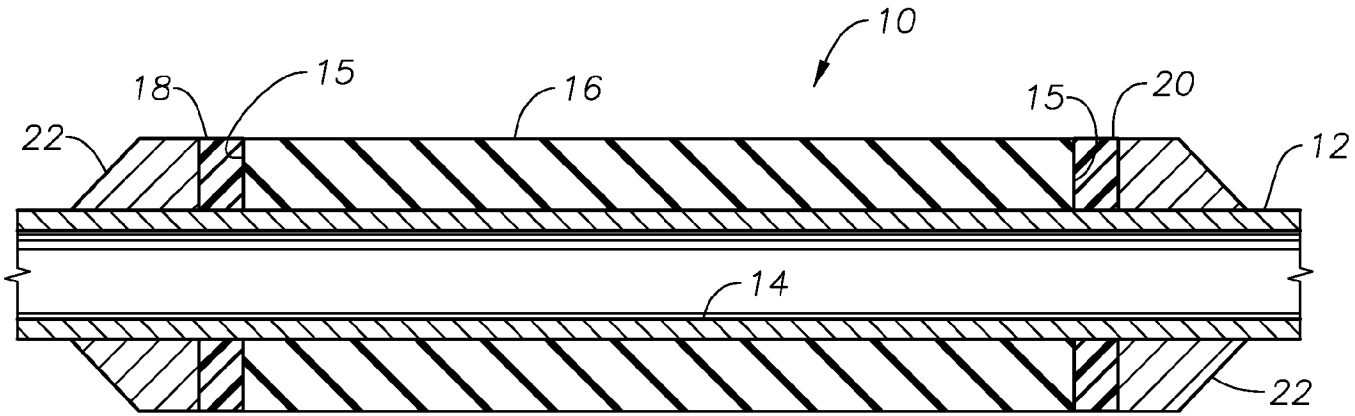
FIG. 1 is a side, cross-sectional view of an exemplary packer device constructed in accordance with the present invention.

FIG. 1 illustrates an exemplary swellable packer assembly 10 constructed in accordance with the present invention. The packer assembly 10 includes a central packer mandrel 12 that defines a flowbore 14 along its axial length. The packer mandrel 12 has axial ends (not shown) provided with threaded connections that permit the packer device 10 to be incorporated into a production tubing string or other downhole tool string, in a manner known in the art.

Surrounding the packer mandrel 12 is a tubular packer sealing element 16 that is formed of a material that expands in response to contact with wellbore liquids. In a currently preferred embodiment, the sealing element 16 comprises an elastomer that will swell or expand in response to contact with wellbore fluids, including water and/or hydrocarbon fluids. Elastomeric materials of this type are described in, for example, U.S. Pat. No. 5,384,370 issued to Vondracek et al., entitled "Rubbers Swellable with Water and Aqueous Solutions and the Method for Producing the Same" and U.S. Pat. No. 4,590,227 issued to Nakamura et al., entitled "Water-Swellable Elastomer Composition." The sealing element 16 preferably has an open cylindrical form and has axial ends 15.

First and second thermoplastic support ring components 18, 20 are located at each axial end 15 of the sealing element 16. Metallic stop rings 22 abut the thermoplastic ring components 18, 20 on the side opposite the sealing element 16 and are fixedly secured to the packer mandrel 12 by threading, splining or other known technique. The thermoplastic ring components 18, 20 are formed of a thermoplastic material that swells or radially expands in response to contact with wellbore fluids. In a preferred embodiment, the thermoplastic ring components 18, 20 swell or expand more rapidly than the sealing element 16. This more rapid swell will act to protect the sealing element 16 until it is fully expanded. Also, the ring components 18, 20 could have less ultimate swell than the sealing element 16 in large holes, maintaining superior material properties in order to support the sealing element 16 and prevent extrusion related to differential pressure. Further, the ring components 18, 20 could have rigid mechanical properties for support but also have proportionately less compliance than the sealing element 16. Swellable thermoplastic materials suitable for this application include known water-absorbent resins, such as cross-linked products of polyacrylates, cross-linked products of starch-acrylate graft copolymers, cross-linked products of a hydrolyzate of starch-acrylonitrile graft copolymer, cross-linked products of carboxymethylcellulose, and others, which are known to those of skill in the art. In an alternative embodiment, the ring components 18, 20 may be fashioned from structural foam. Further, the ring components may be formed of an elastic memory foam, such as Tembo™ foam, an open cell syntactic foam manufactured by Composite Technology Development, Inc.

Figure 2:
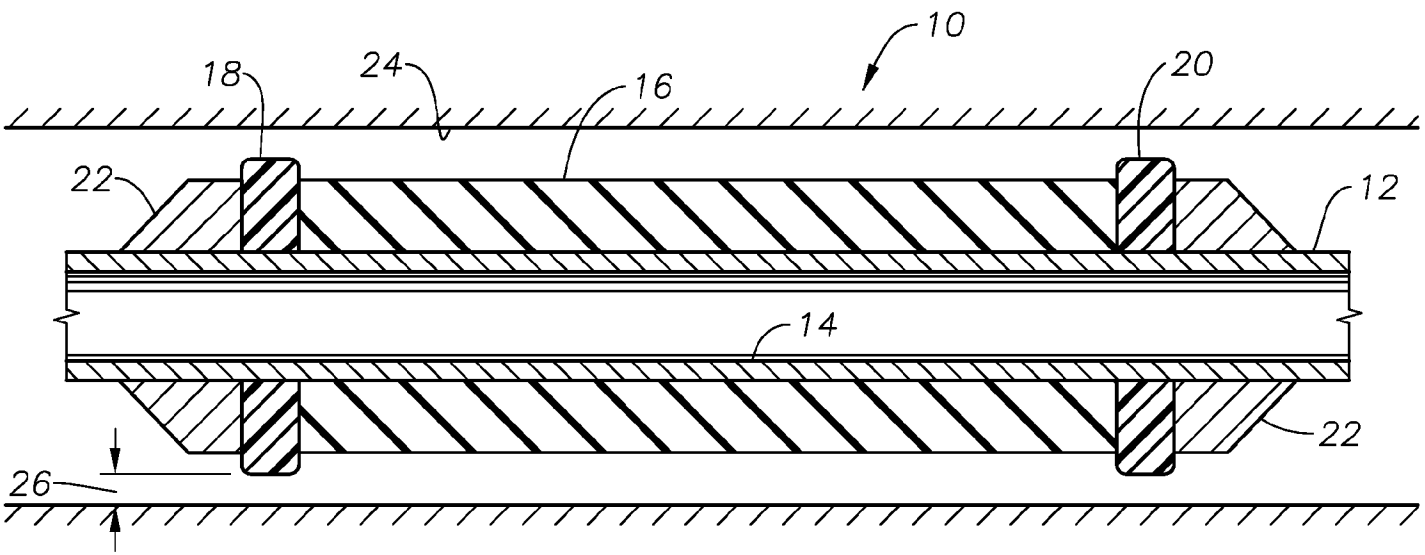
FIG. 2 is a side, cross-sectional view of the packer device shown in FIG. 1, now in a partially set condition.
Figure 3:
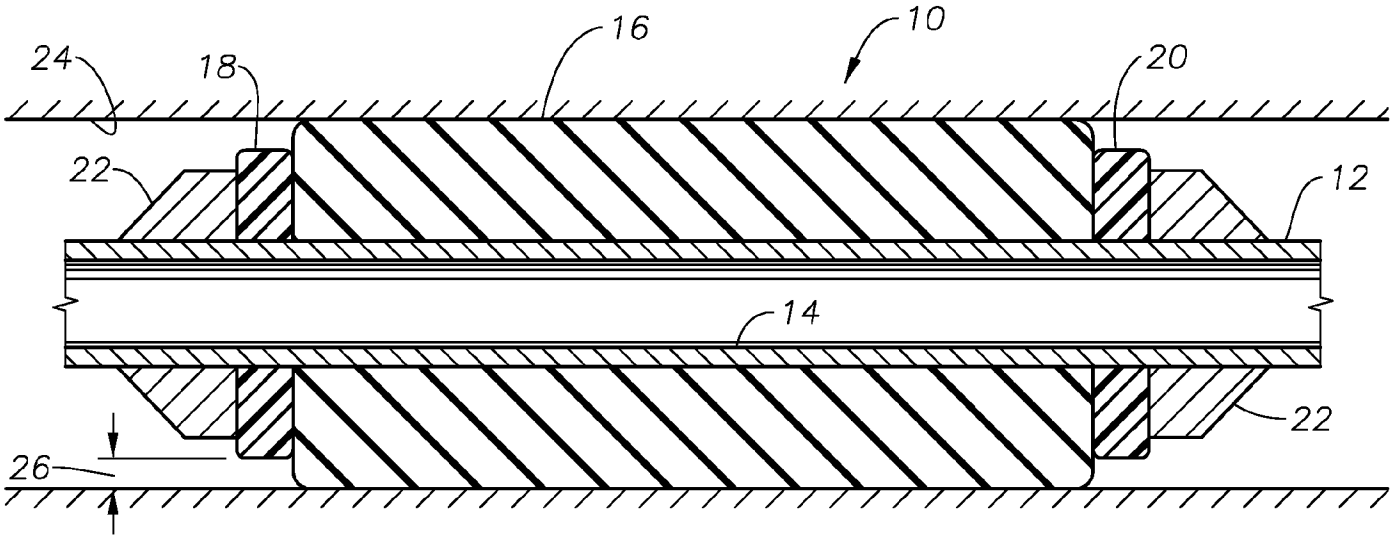
FIG. 3 is a side, cross-sectional view of the packer device shown in FIGS. 1 and 2, now in a fully set condition.

FIG. 1 depicts the packer device 10 in an initial, unset position. FIG. 2 illustrates that the packer device 10 has been disposed within a wellbore, the interior wall of which is shown at 24. As wellbore fluids within the wellbore 24 contact the packer device, the thermoplastic support ring components 18, 20 expand radially outwardly, as depicted in FIG. 2 shows. Thereafter, the sealing element 16 will begin to expand radially, as FIG. 3 depicts. As the sealing element 16 expands radially, it will contact and seal against the surface of the wellbore 24 and create a fluid seal. The expanded condition of the thermoplastic ring components 18, 20 helps to prevent axial extrusion of the elastomeric sealing element 16 by substantially closing the size of the gap 26 between the ring components 18,20 and the wall of wellbore 24. The expanded thermoplastic support rings 18,20 thereby provide mechanical backup elements for the sealing element 16, and results in an improved seal by the sealing element 16. Stop rings 22 are secured to the central mandrel 12 on the axial side of each support ring 18, 20 opposite the sealing element 16. The stop rings 22 serve to retain the thermoplastic rings 18, 20 axially in place upon the mandrel 12. The stop rings 22 are preferably fixedly secured to the mandrel 12 by threading, splining, the use of connectors or in other ways known in the art. The stop rings 22 may be fashioned from metal or another suitable material.

Figure 4:
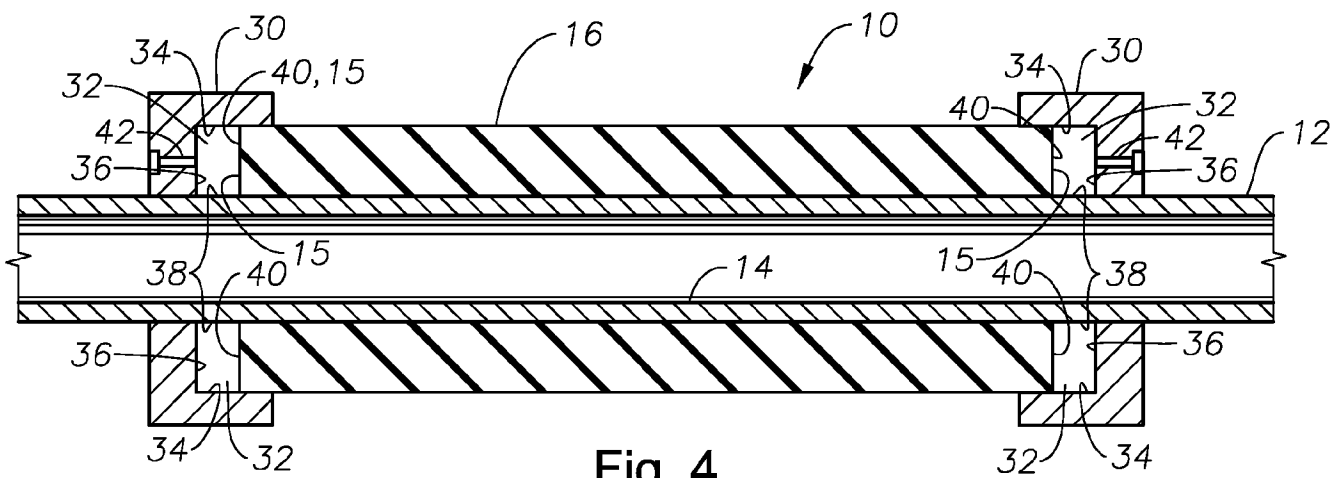
FIG. 4 illustrates an exemplary operation of injection molding to form support rings for the packer device wherein injection mold housings have been secured to the packer mandrel of the packer device.
Figure 5:
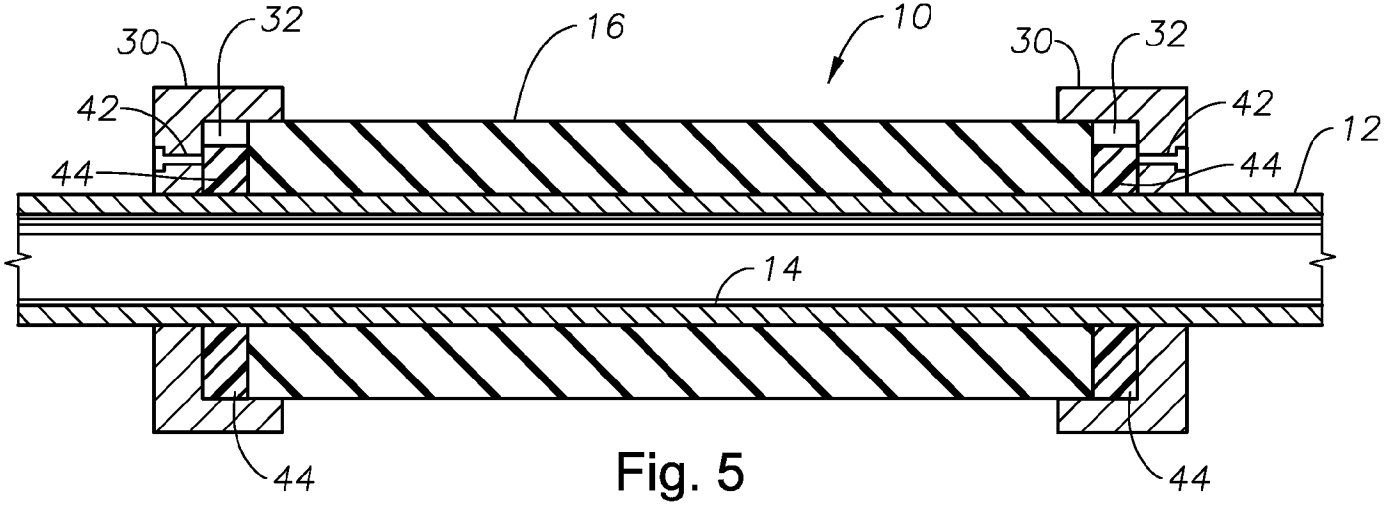
FIG. 5 depicts the injection molds shown in FIG. 4 now being filled with molten thermoplastic material.

In one preferred embodiment of the invention, injection molding is used to form the support rings 18, 20 and dispose them onto the packer mandrel 12. FIGS. 4 and 5 depict an exemplary operation to form the support rings 18, 20 on the central mandrel 12 by injection molding. Mold housings 30 are disposed onto the central mandrel 12 at the axial ends 15 of the sealing element 16, as shown in FIG. 4. The mold housings 30 may be annular housings that are slid on over the ends of the mandrel 12 or, alternatively, may be of a split-ring design in which mold halves or mold sections, are assembled around the mandrel 12. The mold housings 30 define mold cavities 32. It is noted that the mold cavities 32 are defined on their outer radial side 34 and one axial side 36 by the mold housing 30. The radial inner sides 38 of each mold cavity 32 is provided by the radial exterior of the central packer mandrel 12, and the other axial side 40 of the mold cavity 32 is provided by an axial end 15 of the packer sealing element 16. The mold housings 30 each contain one or more injection ports 42 for the injection of molten thermoplastic material through the mold housings 30 and into the mold cavities 32. FIG. 5 illustrates the mold cavities 32 partially filled with molten thermoplastic material 44.

After injection of molten thermoplastic material 44 into the cavities 32, the molten thermoplastic is permitted to cure by cooling and hardening, thereby forming the support rings 18, 20. After curing is complete, the mold housings 30 can be removed from the central mandrel 12 leaving the support rings 18, 20 in place.

Figure 6:
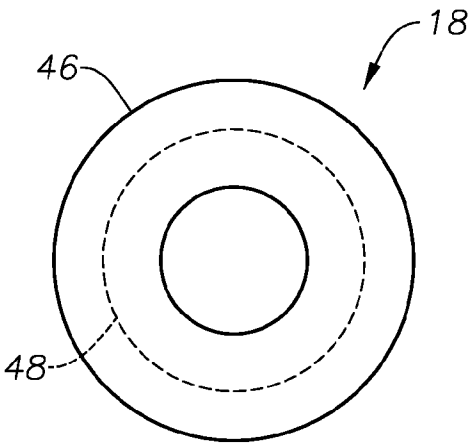
FIG. 6 is a side view of a support ring for use in the packer device shown apart from the other components of the packer device.

FIG. 6 illustrates an alternative method of forming the thermoplastic support ring components 18 and 20. Support ring 18 is shown in side view apart from the other components of the packer device 10. In this embodiment, the support rings 18, 20 are formed of a compressible structural thermoplastic foam, of a type known in the art. The ring 18 presents an original, expanded outer radial diameter 46 corresponding to an enlarged state. In accordance with an exemplary method of creating the support ring 18 (and 20), the thermoplastic foam used to form the ring 18 is soaked in a suitable adhesive. The foam is then physically compressed to a compressed state so as to remove entrained air from air spaces within the foam material. FIG. 6 illustrates a reduced diameter outer radial surface (shown in phantom lines) at 48. Thereafter, the adhesive is cured, causing the foam to remain in its compressed state. It is noted that, in one method of forming the support rings 18, 20, the rings 18, 20 are first formed of the compressible foam in an expanded form, as depicted in FIG. 6, and then physically compressed, as illustrated. Alternatively, a block of compressible foam may be soaked in adhesive and then physically compressed and cured. Thereafter, the support rings 18, 20 may be cut from the material at a sized and shape that will provide unexpanded support members 18, 20.

Those of skill in the art will recognize that numerous modifications and changes may be made to the exemplary designs and embodiments described herein and that the invention is limited only by the claims that follow and any equivalents thereof.

What is claimed is:

1. A packer device for use in a wellbore comprising:

a central packer mandrel;

a packer sealing element radially surrounding the packer mandrel and being substantially formed of an elastomeric material that is swellable in response to wellbore fluids between a radially contracted condition and a radially expanded condition; and a support ring abutting an axial end of the packer sealing element, the support ring being substantially fashioned from a thermoplastic material that is swellable in response to wellbore fluids between a radially contracted condition and a radially expanded condition.

2. The packer device of claim 1 wherein there are two support rings and wherein the support rings are disposed at axial ends of the packer sealing element and wherein radial expansion of the support rings helps to prevent axial extrusion of the packer element.

3. The packer device of claim 2 further comprising two stop rings radially surrounding the central mandrel and fixedly secured thereto to retain the support rings axially in place upon the mandrel.

4. The packer device of claim 1 wherein the support ring expands more rapidly than the packer sealing element expands in response to wellbore fluids.

5. The packer device of claim 1 wherein the support ring is formed of compressible thermoplastic foam.

6. The packer device of claim 5 wherein the compressible foam is:

soaked in an adhesive in an enlarged state; and compressed to a compressed state until the adhesive substantially cures.

7. A packer device comprising:

a central packer mandrel;

a packer sealing element radially surrounding the packer mandrel and being substantially formed of an elastomeric material that is swellable in response to wellbore fluids between a radially contracted condition and a radially expanded condition, the packer element presenting two axial ends; and first and second support rings, each of the support rings abutting an axial end of the packer element, the support rings each being substantially fashioned from a thermoplastic material that is swellable in response to wellbore fluids between a radially contracted condition and a radially expanded condition.

8. The packer device of claim 7 further comprising two stop rings radially surrounding the central mandrel and fixedly secured thereto to retain the support rings axially in place upon the mandrel.

9. The packer device of claim 7 wherein the support rings expand more rapidly than the packer sealing element expands in response to wellbore fluids.

10. The packer device of claim 7 wherein the first and second support rings are formed of compressible thermoplastic foam.

11. The packer device of claim 10 wherein the compressible foam is:

soaked in an adhesive in an enlarged state; and compressed to a compressed state until the adhesive substantially cures.

12. A method of forming a packer device for a wellbore comprising:

disposing a packer sealing element radially around a packer mandrel, the packer sealing element being substantially formed of an elastomeric material that is swellable in response to wellbore fluids between a radially contracted condition and a radially expanded condition; and disposing first and second support rings radially around the packer mandrel and abutting the axial end of the packer sealing element, the first and second support rings being substantially fashioned from a thermoplastic material that is swellable in response to wellbore fluids between a radially contracted condition and a radially expanded condition.

13. The method of claim 12 further comprising the step of disposing one or more stop rings radially around the packer mandrel and fixedly securing the one or more stop rings to the packer mandrel to retain the support rings axially in place upon the packer mandrel.

14. The method of claim 12 wherein the step of disposing the first and second support rings radially around the packer mandrel comprises molding said first and second support rings in place around the packer mandrel.

15. The method of claim 12 further comprising the step of forming the support rings from compressible thermoplastic foam.

* * * * *